US006776477B2

(12) United States Patent
Putman et al.

(10) Patent No.: US 6,776,477 B2
(45) Date of Patent: Aug. 17, 2004

(54) MECHANICAL SEAL CAP FOR INK-CARTRIDGE

(75) Inventors: William A. Putman, Franklin, TN (US); Stephen A. Anderson, Thompson Station, TN (US)

(73) Assignee: Seiko Epson Corporation, Nagano (JP)

( * ) Notice: Subject to any disclaimer, the term of this patent is extended or adjusted under 35 U.S.C. 154(b) by 0 days.

(21) Appl. No.: 10/148,985

(22) PCT Filed: Oct. 5, 2001

(86) PCT No.: PCT/US01/31260

§ 371 (c)(1),
(2), (4) Date: Jun. 4, 2002

(87) PCT Pub. No.: WO02/28645

PCT Pub. Date: Apr. 11, 2002

(65) Prior Publication Data

US 2003/0081085 A1 May 1, 2003

Related U.S. Application Data

(60) Provisional application No. 60/239,075, filed on Oct. 6, 2000.

(51) Int. Cl.[7] ..... B41J 2/01

(52) U.S. Cl. ..... 347/84; 347/85; 347/86; 347/87

(58) Field of Search ..... 347/84, 85, 86, 347/87

(56) References Cited

U.S. PATENT DOCUMENTS

| | | | | | |
|---|---|---|---|---|---|
| 4,700,202 | A | | 10/1987 | Kuranishi et al. | 347/86 |
| 5,576,749 | A | | 11/1996 | Mochizuki et al. | 347/86 |
| 5,721,576 | A | * | 2/1998 | Barinaga | 347/85 |
| 6,312,115 | B1 | * | 11/2001 | Hara et al. | 347/86 |

* cited by examiner

*Primary Examiner*—Stephen Meier
(74) *Attorney, Agent, or Firm*—Squire, Sanders & Dempsey, LLP

(57) ABSTRACT

An ink tank cartridge includes a housing with a bottom wall and a plurality of side walls forming a cavity. An ink supply member having a port extends from the housing. A seal member is inserted into the ink supply member for sealing the port. A retaining capis used to hold the seal member in place. The retaining cap has an opening to provide access to the seal member. An ink supply needle passes through the cap opening to pierce the seam member. The retaining cap has slots to receive ribs located on the outlet port.

15 Claims, 3 Drawing Sheets

MECHANICAL SEAL CAP FOR INK-CARTRIDGE

CROSS-REFERENCE TO RELATED APPLICATIONS

This application claims priority from Provisional Application No. 60/239,075 filed on Oct. 6, 2000.

BACKGROUND OF THE INVENTION

This invention relates generally to the ink-jet printing art for ejecting ink droplets on a recording medium, such as paper, and more particularly, to an assembly for sealing an outlet port of an ink tank cartridge for use in an ink-jet type recording apparatus such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. However, undesired air bubbles can easily enter the ink tank during the filling process which cause problems such as ink supply failure. Controlling the leakage of ink from the cartridge is also a concern.

A cartridge is often divided into multiple chambers, where a porous foam or material is positioned over an outlet port in one chamber and free ink is filled into the other chamber. The free ink migrates from its chamber into the foam through an opening providing communication between the two chambers. The foam then controls the flow of ink as it migrates toward the ink outlet port.

When manufacturing such cartridges, the ink must be contained in the cartridge until the cartridge is mounted into the ink-jet recording device. The ink is contained within the cartridge using a sealing mechanism that is later pierced by an ink supply needle of the ink-jet recording apparatus. Prior art cartridges show sealing the outlet ports of such cartridges using a foil type structure that is pierced by the ink supply needle. Still other use a seal member such as a septum, grommet, or o-ring type seal assembly, either alone or in conjunction with the foil seal.

The sealing mechanism is exposed to pressures that tend to push or blow out these known seal members. For example, ink is pressure filled into the cartridge and the seal member must be capable of withstanding the pressure. Likewise, once the cartridge is filled, pressure differentials are exerted across the seal member and it must be securely maintained in position. Still further, the seal member is subject to manual deformation as the cartridge is inserted and removed from the supply needle associated with the printer. Again, known seal structures have attempted to minimize the impact of these forces on the seal member so that it is securely retained in place. These proposed solutions are deemed too difficult, expensive, or impractical.

Accordingly, a need exists to develop a new and improved ink cartridge having an improved seal assembly that overcomes the above stated problems and provides better, more advantageous overall results.

SUMMARY OF THE INVENTION

Generally speaking, in accordance with the invention, an ink tank cartridge is provided for an ink-jet type recording apparatus being removably mounted on an ink supply needle of a recording body.

More particularly, the invention relates to a mechanical sealing assembly for sealing an outlet port of an ink tank cartridge used with an ink-jet type recording apparatus, such as an ink-jet printer, which is removably mountable onto an ink supply needle of the recording apparatus. The ink tank cartridge includes a housing having a bottom wall and a plurality of side walls forming a cavity. The bottom wall of the housing has an opening allowing ink to pass through. An outlet port depends from the bottom wall and has a pipe-like structure or chimney that communicates with the chamber through the bottom wall opening. The chimney has spaced apart ribs extending longitudinally along its outer surface.

A sealing member is placed inside the outlet port to seal ink inside the chamber. A retaining ring or cap is attached to an outlet end of the outlet port to retain the sealing member within the port while the ink tank cartridge is subjected to pressure differentials, and selectively secured to and removed from the ink-jet type printer. The retaining cap has a central opening so that the sealing member is accessible through the opening. The ink supply needle passes through the opening in the cap to pierce the sealing member when and as the cartridge is installed in the printer. The retaining cap has a peripheral wall defining slots that can receive the outlet port ribs.

Still other aspects of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
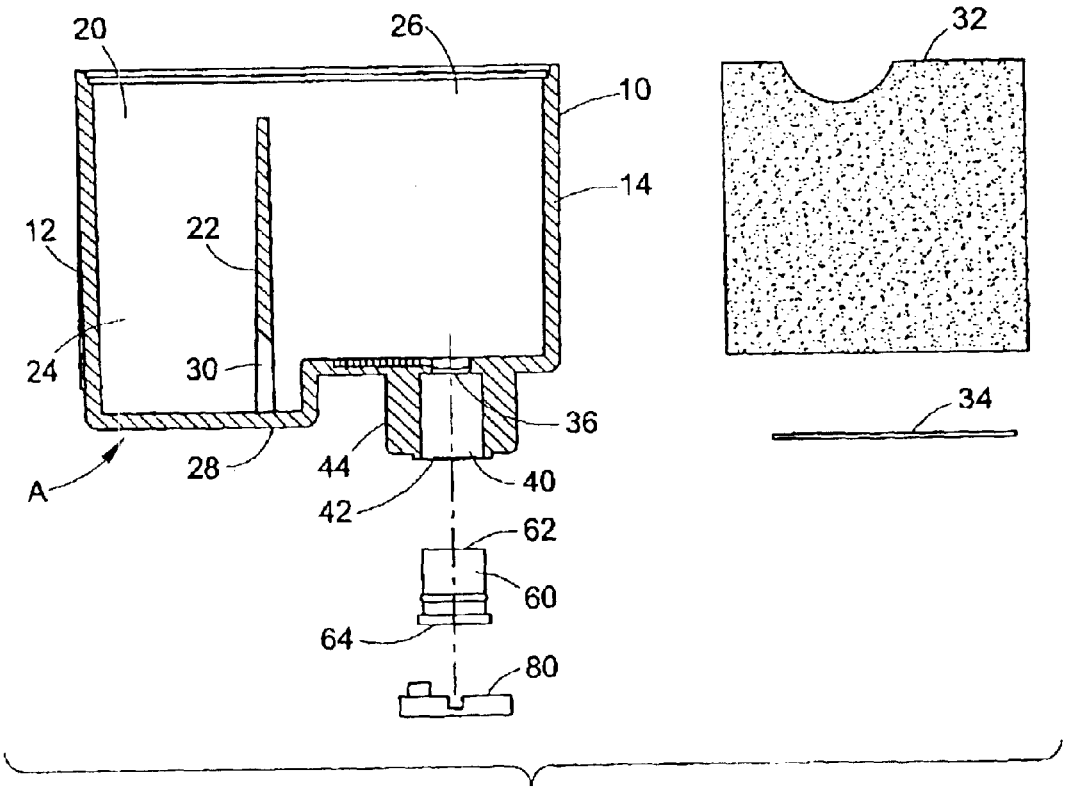
FIG. 1 is an exploded elevational view in cross-section of an ink cartridge according to the preferred embodiment of the present invention.

Referring now to the drawings, wherein the showings are for purposes of illustrating a preferred embodiment of the invention only and not for purposes of limiting same. FIG. 1 shows an ink tank cartridge A according to the present invention.

More specifically, the ink tank cartridge includes a case or housing 10 which defines an internal cavity of a generally rectangular cross-section. The housing has a series of walls 12, 14, 16, 18, which form an internal cavity 20. An additional wall 22 divides the housing internal cavity into two chambers 24,26. Here, the chambers are substantially equally sized. The wall 22 extends laterally between opposed sides of the housing and extends upwardly from a bottom wall 28 to an open top end of the housing effectively dividing the internal cavity into first and second chambers. An opening 30 extends below a bottom of the wall 22 adjacent the bottom wall placing the chambers into communication with each other for ink storage and transfer purposes. Chamber 24 is used to store free ink while chamber 26 is used to store ink in an ink absorbing or porous member 32. It will be appreciated by one skilled in the art that, although only a single pair of chambers is disclosed herein for a single ink supply, this invention would equally apply to multiple chamber pairs and/or multiple inks or ink colors.

Figure 2A:
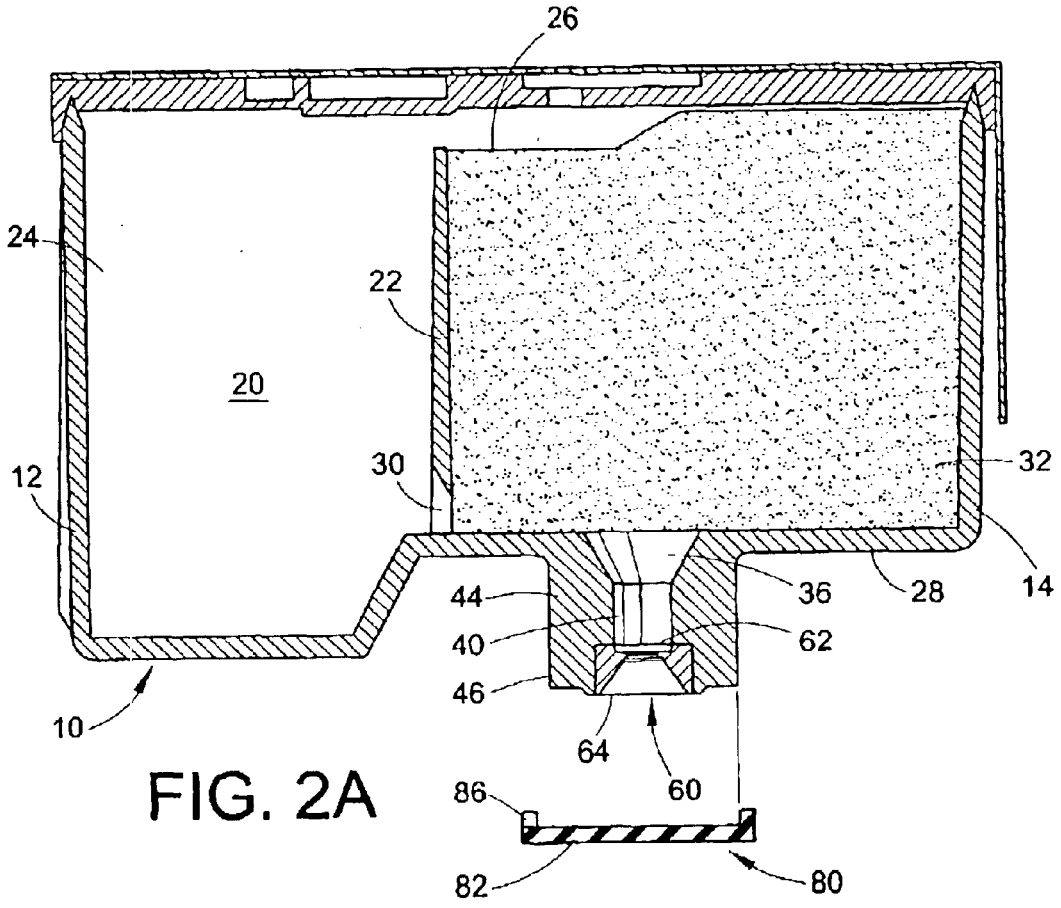
FIG. 2A is a side elevational view in cross section of the ink cartridge of FIG. 1 in an assembled configuration.
Figure 2B:
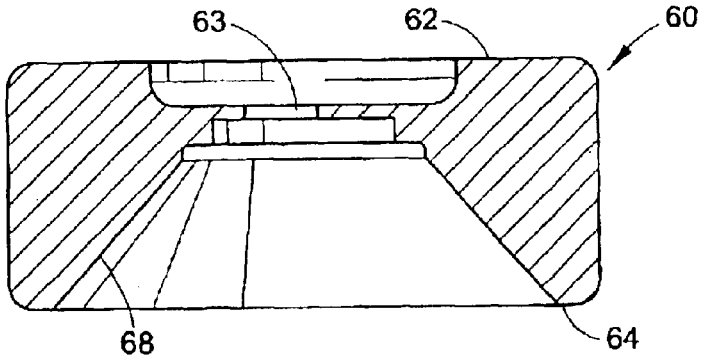
FIG. 2B is an enlarged elevational view in cross-section of the sealing member.
Figure 3:
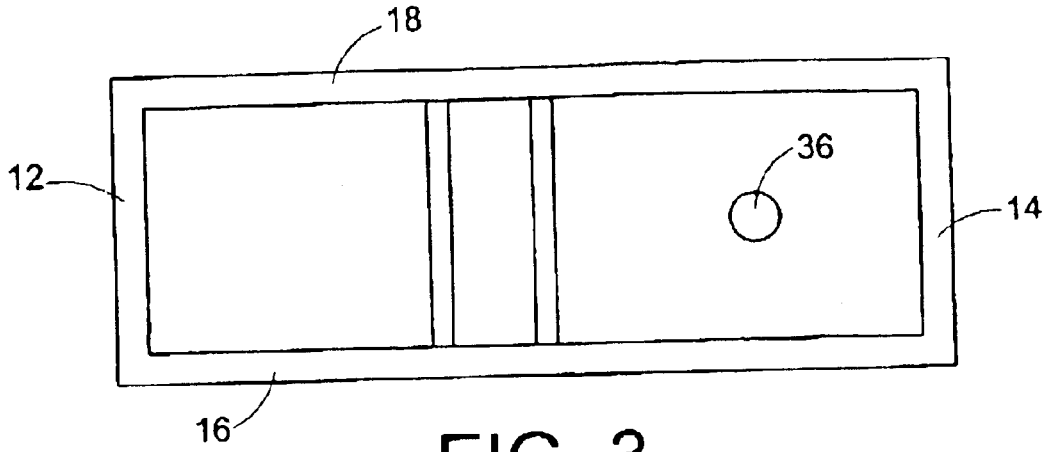
FIG. 3 is a top plan view of the interior of the ink cartridge of FIG. 1.

The ink absorbing member is a block of porous material or foam and is preferably formed of Melamine™ or hydrophilic foam. It will be appreciated, however, that other materials may be used for storing ink without departing from the scope and intent of the present invention. The absorbing member is disposed in chamber 26 adjacent an opening 36 which is in communication with an outlet port 40 which depends from the bottom wall of the housing. A filter or screen 34 is inserted in the cartridge over the outlet port. The screen is interposed between the ink absorbing member and the outlet port to prevent egress of air bubbles, contaminants, and the like from the cartridge. Filter 34 preferably comprises mesh, such as a woven material having a pore size of about 0.5 to 100 microns, and preferably 1–20 microns, secured over the inner opening of the ink supply port, for example by fuse bonding the filter to the bottom wall of the housing. The outlet port 40 comprises a cavity or opening 42 through a pipe-like member or chimney 44 which extends from the bottom wall of the housing. The opening 42 is in communication with the chamber 26 through opening 36. As best seen in FIG. 2, a plurality of longitudinal ribs 46 are located along an outside wall of the chimney. In this embodiment, four ribs are spaced equally apart around the perimeter of the chimney.

After the filter and ink absorbing member has been installed and properly positioned in the respective first chamber, a cover (not shown) is fixedly secured to the housing such as by ultrasonic welding. The height of the ink absorbing member is slightly less than the inside height of the housing as measured between the bottom wall and the underside of the cover. Thus, there is no compression of the ink absorbing member in the vertical direction.

The ink absorbing member has pore sizes which are larger than those in the filter screen. Furthermore, the ink absorbing member may be constructed with a cross-sectional width slightly greater than the chamber of the housing.

A seal member, sometimes referred to as a grommet, 60 (FIG. 2B) is inserted into opening 42 of the outlet port. The grommet is a silicone rubber or another resilient or elastomeric material. The grommet prevents the flow of ink through the outlet port until the grommet is pierced by the ink supply needle of the ink-jet printer. In addition, the grommet 60 prevents flow of ink through the outlet port other than through the ink supply needle. The grommet forms an ink-tight seal between itself and the walls of opening 42. The grommet is a generally cup-shaped silicone member with a flexible membrane and is disposed with an open end 62 facing toward the interior of the housing. A web 63 of material is disposed closely adjacent an other, or outer, end 64 which closes the grommet forming an ink-tight seal at the grommet end. The closed end of the grommet is subsequently pierced by a needle associated with the printer to create an ink supply or withdraw opening only when and as the cartridge is mounted in a printer. Preferably the grommet has a wide, tapered entrance 68 extending inwardly from the outer end 64 for guiding and locating the needle toward the web 63. It will be appreciated that in other embodiments, the open end 62 of the housing may be elongated (as illustrated in FIG. 1) without departing from the scope and intent of the invention.

Figure 4:
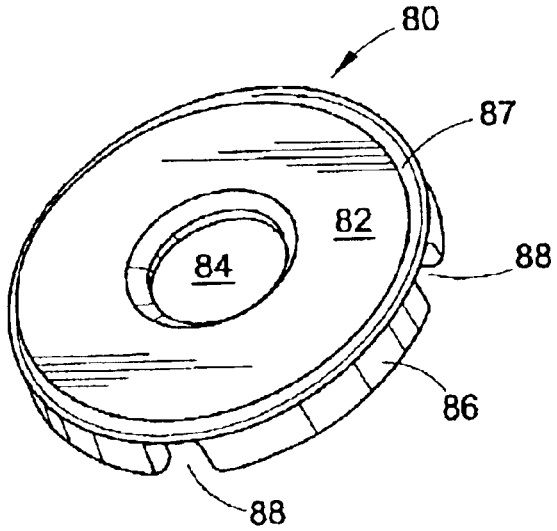
FIG. 4 is a top perspective view of a retaining cap that retains a sealing member inside an outlet port of the ink cartridge when the ink cartridge is being removed from the ink-jet recording apparatus; and, FIG. 5 is a bottom perspective view of the retaining cap of FIG. 4.
Figure 5:
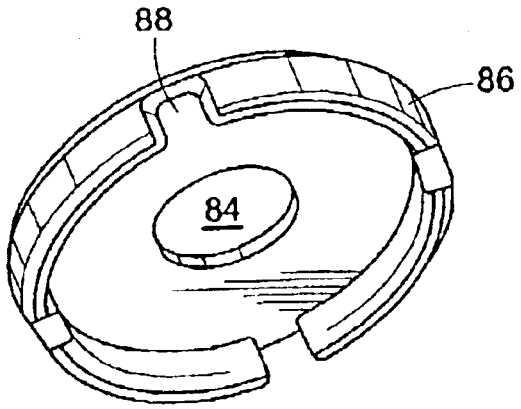

A grommet retaining member or cap 80 is secured onto the outer end of the chimney, such as by ultrasonic welding. The grommet is preferably fabricated from polypropylene, although other suitable materials may be used with equal success. The cap retains the grommet inside the outlet port while the cartridge is being installed or removed from the ink-jet recording device, and also serves to retain the grommet when it is exposed to a pressure differential or a large internal pressure such as during pressurized filling of the cartridge. As seen in FIGS. 4 and 5, the cap is preferably annular having a wall 82 and an enlarged central opening 84 to provide access to the grommet and outlet port. Depending from the cap surface is a peripheral wall 86. A chamfered edge 87 is located at the intersection of the peripheral wall 86 and the cap surface 82. In the preferred arrangement, the peripheral wall 86 is substantially continuous about the circumference. The peripheral wall includes a plurality of slots 88 that align with and receive the ribs 46 extending radially outward from the ink outlet port. In this embodiment, four slots are equidistant from one another to receive the four ribs equispaced about the perimeter of the ink outlet port.

After the cartridge is exposed to a pre-vacuum, the cartridge is pressure filled with a degassed, water-based ink-jet type ink through a fill hole. Either black ink or different color inks, i.e., cyan, magenta, and yellow ink, are introduced into the cartridge. After filling, the cartridge is inserted into a fixture to seal the cartridge for shipping and storage.

A method of sealing the outlet port of the ink tank cartridge includes the step of placing a sealing member or grommet inside an opening of the outlet port of the ink tank cartridge. The grommet retaining cap is then attached to an outer end of the ink outlet port. The cap has an enlarged central opening so that the grommet is accessible to the ink supply needle. The cap is then ultrasonically welded to the outlet end of the chimney to fixedly secure the retaining cap and grommet in place.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the preferred embodiment, the invention is now claimed to be:

1. An ink-jet cartridge, being removably mounted onto an associated ink-jet supply needle of an ink-jet printer, said ink cartridge comprising:

a housing having a chamber;

an outlet port in communication with the chamber;

a seal member received in the housing for sealing the outlet port; and, a cap shaped retaining member having an aperture and being attached to the housing at the outlet port for retaining said seal member;

wherein the cap shaped retaining member further comprises a wall defining the aperture and a peripheral wall having a plurality of slots in spaced location.

2. The ink-jet cartridge of claim 1, wherein the seal member forms an ink-tight seal between the seal member and an inside wall of the outlet port.

3. The ink-jet cartridge of claim 1, wherein the outlet port further comprises ribs formed on an outer surface of the outlet port.

4. The ink-jet cartridge of claim 1, wherein the cap shaped retaining member is annular.

5. The ink-jet cartridge of claim 1, wherein the outlet port further comprises ribs formed on an outer surface and the slots are adapted to receive the outlet port ribs.

6. The ink-jet cartridge of claim 1, wherein the seal member is accessible through the aperture of said cap shaped retaining member.

7. The ink-jet cartridge of claim 1, wherein the cap shaped retaining member is a polypropylene material.

8. The ink-jet cartridge of claim 1, wherein the cap shaped retaining member is secured to the outlet port by ultrasonic welding.

9. An assembly for sealing an outlet port of an ink cartridge being removably mounted onto an associated ink-jet supply needle of an ink-jet printer, the assembly comprising:

a seal member disposed inside the port, for preventing the outlet flow of ink through the outlet port; and, a cap shaped retaining member having an opening attached to an outlet end of the port for retaining the seal member inside the port, wherein the cap shaped retaining member comprises a wall having the opening formed therethrough and a peripheral wall having a plurality of slots.

10. The assembly of claim 9, wherein the seal member is accessible through the opening.

11. An assembly for sealing an outlet port of an ink cartridge being removably mounted onto an associated ink-jet supply needle of an ink-jet printer, the assembly comprising:

a seal member disposed inside the port, for preventing the outlet flow of ink through the outlet port; and, a cap shaped retaining member having an opening attached to an outlet end of the port for retaining the seal member inside the port, wherein the outlet port includes circumferentially spaced ribs extending radially outward therefrom, and the slots in the cap shaped retaining member's peripheral wall receive the ribs.

12. An annular cap for retaining a seal member inside an outlet port of an ink cartridge while the cartridge is being removed from an associated ink-jet recording apparatus, the annular cap comprising a first wall having an opening and a second wall depending from the first wall to secure the annular cap to the outlet port of the ink cartridge wherein the second wall defines a plurality of slots.

13. The cap of claim 12, wherein the seal member is accessible through the opening when the annular cap is attached to the outlet port.

14. The annular cap of claim 12, wherein the second wall depends from a peripheral edge of the first wall.

15. An ink tank cartridge for an associated ink-jet printer removably mountable onto an associated ink-jet supply needle, the ink tank cartridge comprising:

a housing having a bottom wall and a plurality of side walls forming a chamber;

an ink supply member provided in the bottom wall of the housing having a port communicating with the chamber and a plurality of ribs extending along an outer surface of the ink supply member;

a seal member inserted in the ink supply member, for preventing the flow of ink through the port until after the sealing member is pierced by the ink-jet supply needle and preventing the flow of ink through the outlet port other than through the ink supply needle; and an annular retaining cap attached to an outlet end of the ink supply member to retain the seal member, wherein the cap has an opening providing access to the seal member and a well with slots for engaging the ribs.

* * * * *